US005586524A

United States Patent [19]

Nonaka et al.

[11] Patent Number: 5,586,524

[45] Date of Patent: Dec. 24, 1996

[54] FUEL INJECTION CONTROL SYSTEM FOR INTERNAL COMBUSTION ENGINE

[75] Inventors: Kimihiro Nonaka; Hiroaki Ohtani, both of Hamamatsu, Japan

[73] Assignee: Sanshin Kogyo Kabushiki Kaisha, Hamamatsu, Japan

[21] Appl. No.: 299,519

[22] Filed: Sep. 1, 1994

[30] Foreign Application Priority Data

Sep. 1, 1993 [JP] Japan ..... 5-217771
Sep. 1, 1993 [JP] Japan ..... 5-217772
Sep. 1, 1993 [JP] Japan ..... 5-217773

[51] Int. Cl.[6] ..... F02D 41/04; F02B 33/04

[52] U.S. Cl. ..... 123/73 A; 123/478; 123/494

[58] Field of Search ..... 123/73 R, 73 A, 123/73 B, 73 C, 494, 478

[56] References Cited

U.S. PATENT DOCUMENTS 4,461,260 7/1984 Nonaka et al. ..... 123/73 R X
5,127,373 7/1992 Mochizuki et al. ..... 123/73 R
5,134,984 8/1992 Nonaka et al. ..... 123/73 C X
5,284,118 2/1994 Kato et al. ..... 123/478
5,329,907 7/1994 Nonaka ..... 123/478
5,367,998 11/1994 Shiohara et al. ..... 123/73 C X
5,404,843 4/1995 Kato ..... 123/73 B

*Primary Examiner*—Tony M. Argenbright
*Attorney, Agent, or Firm*—Knobbe, Martens, Olson & Bear

[57] ABSTRACT

A fuel injection control system accurately determines the amount of fuel to be injected by compensating the measured crankcase pressure in view of various conditions including intake air condition, effects of exhaust gas pressure by other cylinder and others, with use of one pressure sensor. The fuel injection control system includes a pressure sensor installed in a cylinder of the engine for detecting crankcase pressure, a fuel injector for injecting fuel to the engine on the basis of the crankcase pressure detected by the pressure sensor, and a device for compensating the amount of fuel injected from the fuel injector depending on the condition of intake air in the crankcase. Another aspect of the system additionally includes controlling timing for detecting the crankcase pressure by the pressure sensor depending on the rotation rate of the engine. Further aspect of the system additionally include determining the amount of fuel to be injected to the engine by incorporating a compensation factor in the crankcase pressure obtained by the pressure sensor wherein the compensation factor includes an effect caused by exhaust gas pressure in other cylinders.

11 Claims, 15 Drawing Sheets

Detect RPM
S 121
Read Crankcase Pressure Detection Timing From Map
S 122
Detect Crankcase Pressure P1, P2'
S 123
Read Intake Air Amount G' From Map
S 124
Determine Pressure P3 Between Crank Angle Θso ~ Θsc
S 125
Read Comp Factor K From Map
S 126
Determine Intake Air G
S 127
S 128
Read Fuel Injection From Map
RPM

FUEL INJECTION CONTROL SYSTEM FOR INTERNAL COMBUSTION ENGINE

BACKGROUND OF THE INVENTION

This invention relates to a fuel injection control system for an internal combustion engine and more particularly to an improved control system and routine for controlling fuel injection in a two-cycle engine.

In an internal combustion engine, it is important to accurately control the amount of fuel injected to the engine to improve fuel economy. A wide variety of types of controls for fuel injection for internal combustion engines have been proposed. These controls generally sense one or more engine parameters and then set the amount of fuel injected in response to the sensed parameters. This setting is normally done by the measuring of the running conditions and then the selection of the fuel injection amount from a map generated from actual running condition. Although these systems are generally quite accurate, they do have some disadvantages.

For example, one parameter that is frequently measured in a two-cycle engine is air flow to the engine. There are various types of air flow sensors which have been employed. One way of measuring the air flow for controlling the fuel injection measures air pressure in the crankcase chamber at different times and derives the air flow from the pressure differences. The amount of fuel injected to the engine is controlled depending on the crankcase pressure detected by a pressure sensor installed in the crankcase.

This method of sensing the crankcase pressure can be quite accurate under many running conditions. However, its accuracy can be not as good as other types of devices under other running conditions. As a result, the amount of fuel supplied under the conditions when the measuring device is not as accurate will also be inaccurate. One of the factors that deteriorates the accuracy resides in the fact that the intake air may include water vapor and/or vaporized fuel such as gasoline. As a result, the measured crankcase pressure by the pressure sensor includes pressure components based on the water vapor and the vaporized fuel other than the intake air pressure to be measured.

Thus, in the conventional system of measuring the crankcase pressure, it is not possible to accurately control the fuel injection. In the crankcase pressure measurement to determine the intake air pressure, the crankcase pressure is measured at two different times. One measurement is performed at the time of starting scavenge (scavenge port opening timing) and the other measurement is performed at the time of ending the scavenge (scavenge port closing timing). The intake air pressure will be calculated based on these two measurement results.

In these measurements, however, an impulse-like pressure caused by an exhaust gas pressure may sometimes comes in the crankcase chamber through a cylinder and a scavenge path. Such an impulse-like pressure of the exhaust gas may derive from the cylinder associated with the crankcase member which is being measured but also from the other cylinders. Especially, this pressure caused by the exhaust gas pressure in the cylinders affects the crankcase pressure measurement at the end timing of the scavenge. As a result, depending on the detection timing, it is difficult to obtain accurate air pressure data, and thus, it is difficult to accurately control the fuel injection.

Further, in the crankcase pressure measurement, it is necessary to install a pressure sensor in each cylinder to measure the intake air with high accuracy. As a consequence, in an engine having a large number of cylinders, for example, six cylinders, six pressure sensors have to be installed. However, such a large number of pressure sensors makes the structure of the system and the process for measuring the intake air complicated. In case where one or two pressure sensors are installed to measure other cylinders, accurate measurement is not possible since the crankcase pressure and intake air are different from cylinder to cylinder. As a result, it is not possible in the conventional crankcase pressure measurement to precisely control the fuel injection. Furthermore, in the two-cycle engine, a misfire wherein one or more cylinders fail to fire will sometimes occur. In such a situation, the crankcase pressure is affected by the misfire and thus it is difficult to accurately control the fuel injection solely based on the crankcase pressure measurement.

It is, therefore, a principal object of this invention to provide an improved fuel injection control system that is capable of accurately control the fuel injection by measuring the crankcase pressure with high accuracy incorporating the intake air condition.

It is a further object of this invention to provide a fuel injection control system for an engine that is capable of measuring the crankcase pressure without being affected by an exhaust gas pressure.

It is a further object of the present invention to provide a fuel injection control system for an engine which is capable of simplifying the structure and calculation process for measuring the intake air.

It is a further object of the present invention to provide a fuel injection control system for an engine which is capable of detecting a misfire of a certain cylinder and compensating for the effect of such a misfire in measuring the crankcase pressure to accurately control the amount of fuel injection to the engine.

SUMMARY OF THE INVENTION

A first aspect of the invention is embodied in a fuel injection control system for an internal combustion engine which is capable of accurately control the fuel injection by measuring the crankcase pressure with high accuracy. The fuel injection control system includes a pressure sensor installed in a cylinder of the engine for detecting crankcase pressure, a fuel injector for injecting fuel to the engine on the basis of the crankcase pressure detected by the pressure sensor, and means for compensating the amount of fuel injected from the fuel injector depending on the condition of intake air in the crankcase.

In accordance with the first feature of the present invention, the amount of fuel injected from the fuel injector is accurately controlled by analyzing the intake air conditions and compensating for the conditions so that the fuel injection is effected solely by the true value of the crankcase pressure.

Another aspect of the present invention is to provide a fuel injection control system for an internal combustion engine which is capable of accurately determining the amount of fuel to be injected without being effected by the exhaust gas pressure by the cylinder where the sensor is installed and by other cylinders. The fuel injection control system includes a pressure sensor installed in a cylinder of the engine for detecting crankcase pressure, a fuel injector for injecting fuel to the engine on the basis of the crankcase pressure detected by the pressure sensor, and means for controlling timing for detecting the crankcase pressure by the pressure sensor depending on the rotation rate of the engine.

According to this invention, the fuel injection control system includes timing control means for adjusting the timing for detecting the crankcase pressure depending on the engine rotation speed. Therefore, the detection of the crankcase pressure can be made at the times during which the crankcase pressure is not effected by the exhaust pressure. As a result, more accurate measurement of the intake air and thus more accurate control of the fuel injection is possible in the present invention.

Another aspect of the present invention is to provide a fuel injection control system for an internal combustion engine which is capable of accurately determining the amount of fuel to be injected by measuring the crankcase pressure of one cylinder by one pressure sensor installed in the cylinder and compensating the measured crank pressure in view of the effects caused by exhaust gas pressure or a misfire in the cylinders of the engine.

The fuel injection control system includes a pressure sensor installed in a cylinder of the engine for detecting crankcase pressure, a fuel injector for injecting fuel to the engine on the basis of the crankcase pressure detected by the pressure sensor, and means for determining the amount of fuel to be injected to the engine by incorporating a compensation factor in the crankcase pressure obtained by the pressure sensor wherein the compensation factor includes an effect caused by exhaust gas pressure in other cylinders.

In accordance with this invention, the measurement of the crankcase pressure is made only for selected one cylinder. The crankcase pressure for the other cylinders is calculated based on the crankcase pressure of the selected cylinder, the interference characteristics between the cylinders and the engine rotation rate. Therefore, the precise control of the fuel injection will be achieved while simplifying the structure of the system.

Furthermore, according to the present invention, it is possible to detect the misfire in the other cylinders by monitoring the crankcase pressure of the predetermined one or two cylinders and compensating for the effect of the misfire to accurately control the fuel injection.

DETAILED DESCRIPTION OF THE PREFERRED EMBODIMENT OF THE INVENTION

Figure 1:
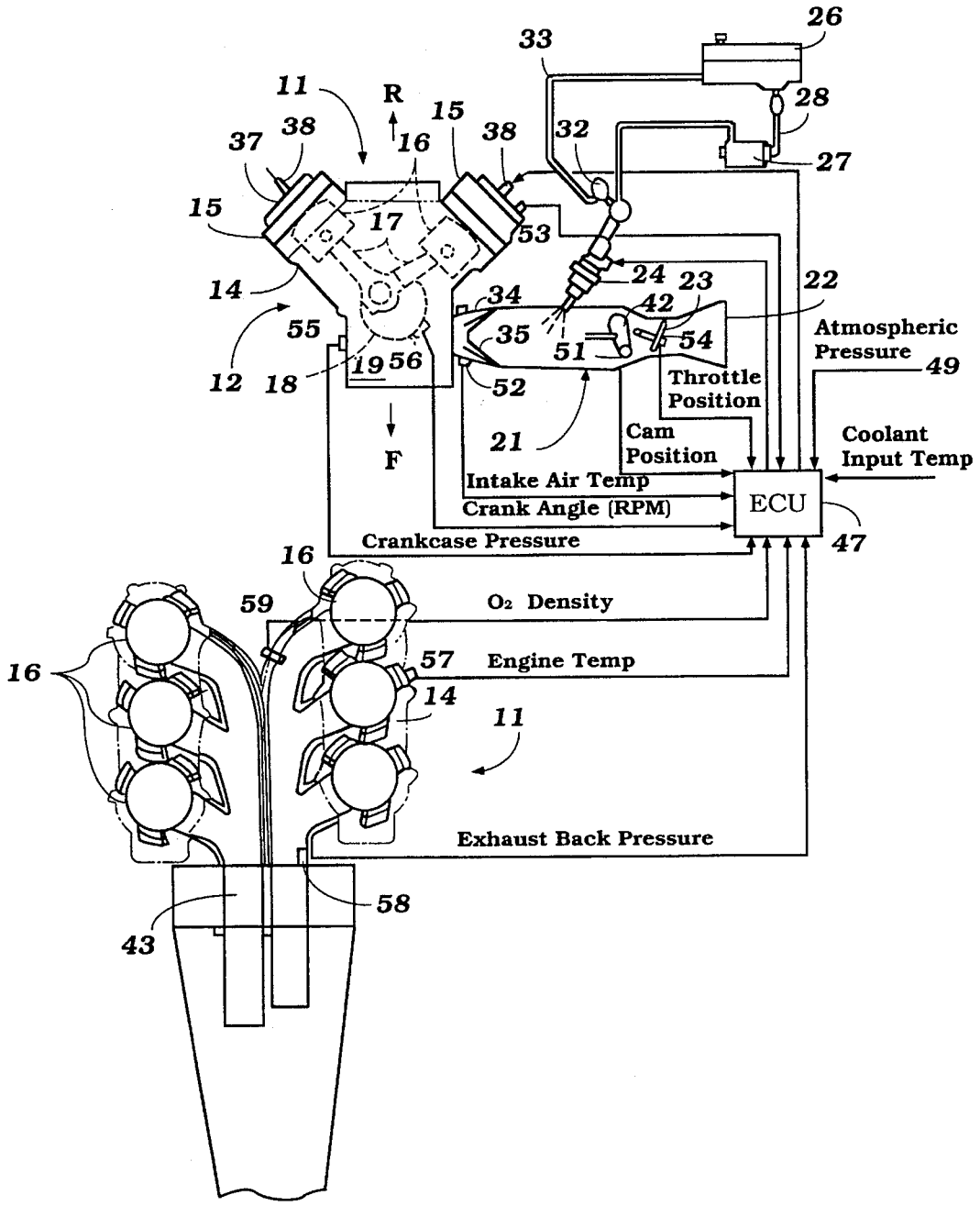
FIG. 1 is a partially schematic view of an outboard motor incorporating an internal combustion engine having a fuel injection control system constructed and operated in accordance with the invention.

Referring now in detail to the drawings and initially to FIG. 1, an outboard motor is shown partially in cross section and with portions shown in phantom and is identified generally by the reference numeral 11. This view is composite view and a single cylinder of the powering internal combustion engine is shown in cross section with the engine being identified generally by the reference number 12 and associated induction system and fuel injection system for it shown partially in cross section and partially schematically. The invention is described in conjunction with an outboard motor only as a typical environment in which the invention may be practiced. The invention has particular utility with two cycle crankcase compression internal combustion engines and since such engines are frequently employed as the power plants for outboard motors. Therefore, an outboard motor is a typical environment in which the invention may be employed.

The outboard motor 11, as already noted, includes a powering internal combustion engine 12 which, in the illustrated embodiment, is comprised of a six cylinder V-type (V-6) engine. In FIG. 1, each cylinder is indicated by a number, No.1–No.6. The numbers 1–6 in the cylinders also indicate the order of ignition in the six cylinders. It will be readily apparent to those skilled in the art how the invention can be employed in connection with engines of other configurations.

The engine 12 forms a portion of the power head of the outboard motor and this power head is completed by a protective cowling (not shown) which surrounds the engine 12 in a known manner. As may be seen in this figure, the engine 12 is comprised of two cylinder blocks 14 each of which includes three aligned cylinder bores 15. Pistons 16 reciprocate in the cylinder bores 15 and are connected to connecting rods 17 which, in turn, drive a crankshaft 18 in a well known manner. The crankshaft 18 is rotatably journaled within a crankcase assembly which is divided into individual chambers 19 each associated with a respective one of the cylinder bores 15 and which are sealed from each other in a manner well known in the art.

A fuel/air charge is delivered to the crankcase chambers 19 by an induction system, indicated generally by the reference numeral 21, and which includes an atmospheric air inlet 22. The induction system 21 includes a throttle valve 23 having a pick-up bar 25 which is orthogonally attached to the throttle valve 23 as shown in the enlarged view of FIG. 2. As is well known in the art, the throttle valve 23 determines the amount air introduced to the crankcase chambers 19.

Figure 2:
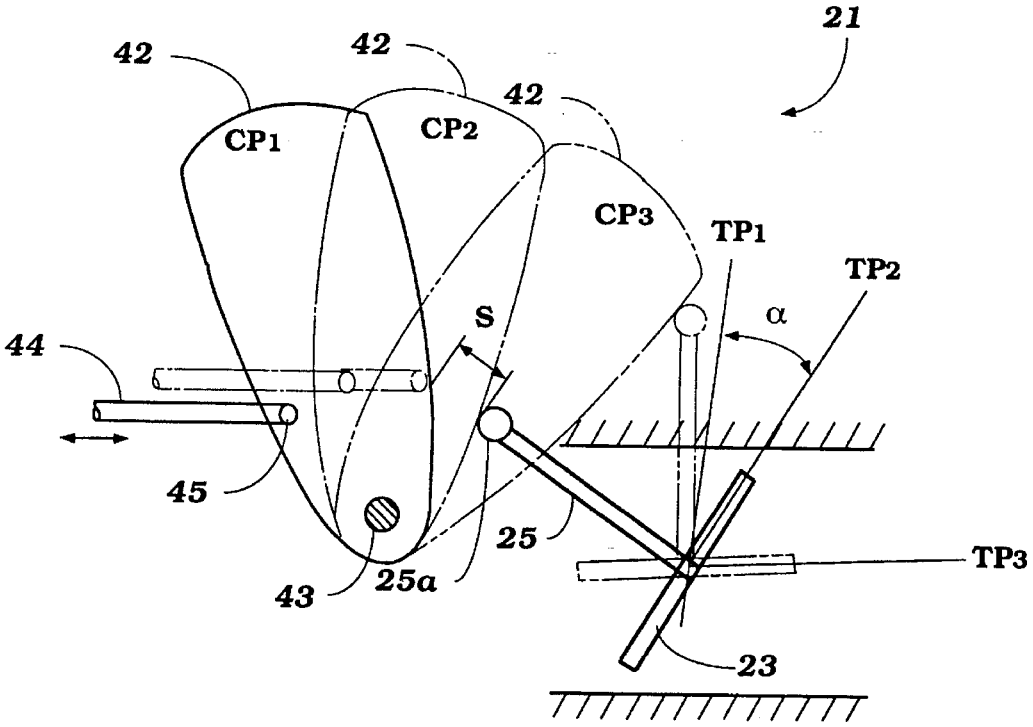
FIG. 2 is a block diagram showing a more detailed structure of an induction system including a throttle valve and a cam member of the fuel injection system.

As seen in FIG. 2, the induction system 21 further includes a cam mechanism 41 having a cam member 42 and an accelerator bar 44. The accelerator bar 44 is connected to the cam member 42 through a pin 45. The other end of the accelerator bar 44 is connected to an accelerator pedal (not shown) to provide a stroke which corresponds to the desired position of the throttle valve 23. The cam member 42 is pivotally connected to the induction system so that it can rotate around a pin 43. The pick-up bar 25 of the throttle valve 23 has a contact portion **25*a* at its end to contact with the circumference of the cam member 42 when the cam member 42 is driven by the accelerator bar 44**.

As seen in FIG. 1, an electronically operated fuel injector 24 sprays fuel into the induction system 21 downstream of the throttle valve 23. The fuel injector 24 receives fuel from a fuel system including a remotely positioned fuel tank 26. Fuel is drawn from the fuel tank 26 by means of a high pressure fuel pump 27, through a conduit 28 in which a filter 29 is positioned. This fuel then delivered to a fuel rail 31 in which a pressure regulator 32 is provided. The pressure regulator 32 maintains the desired pressure in the fuel rail by bypassing excess fuel back to the fuel tank 26 through a return conduit 33. The operation of the fuel injector 24 will be described in more detail later.

The induction system 21 delivers air to the intake ports of the engine through reed type check valves 35 which operate to preclude reverse flow. The inducted charge is drawn into the crankcase chambers 19 upon upward movement of the pistons 16 and then is compressed upon downward movement. The compressed charge is then transferred to the area above the pistons 16 through a plurality of scavenge passages 36 (FIG. 3) in a manner well known in this art.

A cylinder head 37 is affixed to the cylinder block 14 in a known manner and defines a recess which forms part of the combustion chamber. A spark plug 38 is mounted in each cylinder recess and is fired by the ignition system in a known manner. An ignition signal for each spark plug 38 is provided through an electric line from an ECU (electronic control unit) 47. The timing of the ignition is precisely controlled by the ECU 47 as will be described later.

As is typical with outboard motor practice, the cylinder block 14 and cylinder head 37 are formed with cooling jackets through which coolant is circulated from the body of water in which the outboard motor 11 is operating in any conventional manner.

Referring now in more detail to the induction system, the fuel injection system and the control therefor, as previously noted, the movement of the throttle valve 23 and the cam member 42 in the induction system 21 is monitored. And the ignition timing for the spark plug 38 and the fuel injection for the crank chambers 19 from the fuel injector 24 are electronically controlled.

To this end, the induction system 21 is provided with a throttle valve position sensor 54 which senses the position, i.e., angular movement, of the throttle valve and outputs the sensed signal to the ECU 47. The induction system 21 is further provided with a cam position sensor 51 which senses the position, i.e., angular movement, of the cam member and outputs the resulting signal to the ECU 47. The combustion control system of the present invention further includes various sensors which will be described later.

The fuel injector 24 is provided with an electrical terminal that receives an output control signal from an ECU through a conductor indicated by the line 48. A solenoid of the fuel injector 24 is energized with the ECU 47 outputs a signal to the fuel injector 24 through the line 48 to open an injection valve and initiate injection. Once this signal is terminated, injection will also be terminated. The injector 24 may be of any known type and in addition to a pure fuel injector, it may comprise an air/fuel injector.

A number of ambient atmospheric conditions are supplied to the ECU and certain engine running conditions are supplied to the ECU 47 so as to determine the ignition timing by the ignition system, the amount of fuel injected and the timing of the fuel injection by the fuel injector 24. These ambient conditions may comprise atmospheric pressure which is measured in any suitable manner by a sensor and which signal is transmitted to the ECU 47 through a conductor 49, temperature of the cooling water which is delivered to the engine cooling jacket from the body of water in which the watercraft is operating as sensed by an appropriate sensor (not shown) and transmitted to the ECU 47.

One of the other important parameters is the intake air temperature as sensed in the crankcase chamber 19 by a temperature sensor 52 which outputs its signal to the ECU 47 through a conductor. A humidity sensor 50 is provided at the input of the crankcase chamber 19 to measure the humidity of the intake air. The temperature sensor 52 and the humidity sensor 50 play an important role in the present invention to achieve compensation factors for the measurement of the intake pressure data from the pressure sensor 55. Additional ambient conditions may be measured and employed so as to provide more accurate control of the fuel injection, if desired.

In addition to the throttle valve position sensor and the cam position sensor as noted above, there are also provided a number of engine condition sensors which sense the following engine conditions. An in-cylinder pressure sensor 53 senses the pressure within the cylinder and outputs this signal to the ECU 47 through an appropriate conductor. Crankcase pressure is sensed by a pressure sensor 55 which is also mounted in the crankcase chamber 19 and outputs its signal to the ECU 47. Crank angle position indicative of the angular position and rotating speed of the crankshaft 18 is determined by a sensor 56 and outputted to the ECU 47. Engine temperature or intake air temperature is sensed by a sensor 57 mounted in the cylinder block 14 and inputted to the ECU 47. Exhaust system back pressure in the expansion chamber 43 is sensed by a sensor 58 and is outputted to the ECU 47. Finally, a sensor 57 outputs a signal indicative of the density of oxygen ($O_2$) the exhaust gas in the expansion chamber to the ECU 47.

As with the ambient conditions, additional engine running conditions may be sensed. Those skilled in the art can readily determine how such other ambient or running conditions can be sensed and fed to the ECU 47 and processed by the ECU 47 to determine the ignition timing and the fuel injection supply both in timing and amount. The ECU is provided with an information table or a map for determining the ignition timing and the fuel supply based on the various parameters in the engine as noted above.

In FIG. 2, there is shown positional relationship between the cam member 42 and the throttle valve 23 in the induction system 21 of the present invention. When the engine is idling, the cam member 42 is in the position designated by CP1. In the conventional combustion system, in such an idle state of the engine, the throttle valve is positioned at TP1 shown in the figure. In the position TP1, the throttle valve has a very small opening for providing an air to the cylinder enough to a maintain a low rotational speed in the engine. For example, the throttle valve has an angle of 2–3 degrees from a complete close position. However, the air flow will not change in response to a quick opening in the throttle valve position, from the idle position TP1 to the full open position TP3 for example, because of the inertia of the air.

In the preferred embodiment, during the idle, the throttle valve 23 is adjusted to a position TP2 when the cam member 42 is in the idle position CP1 (shown by the dotted line). In the position TP2, the throttle valve 23 has, for example, an angle $\alpha$ of 15–20 degree from the complete closed position TP1. Thus, the throttle valve 23 is stopped by a mechanism (not shown) from further closing an air path. In this situation, there is a gap S between the contact portion 25*a* of the pick-up bar 25 and the circumference of the cam member 42 as shown in FIG. 2. As a result, even when the engine is idling, the sufficient air flow for the rapid acceleration is already preserved in the induction system 21.

In response to the accelerator movement, the cam member 42 shifts its position from the idle position CP1 to the pick-up position CP2 (shown by dashed line). This is the position where the contacts portion 25*a* of the pick-up bar 25 contact with the circumference of the cam member 23 while throttle valve 23 remain in the idle position TP2. After this position, the throttle valve 23 changes its position in proportion to the movement of the cam member 42. Therefore, when the cam member 42 is driven by the accelerator bar 44 to the position CP3 (shown by two dot dashed line), the contact portion 25*a* slides along the circumference of the cam member 42 so that the throttle valve 23 is placed to the full open position TP3. In the full open position TP3, the throttle valve 23 provides the largest amount of air flow with the highest flow speed to the cylinder and the engine rotation rate will become maximum.

The positions of the cam member 42 and the throttle valve 23 are constantly monitored by the sensors 51 and 54, respectively. The sensors 51 and 54 send the sensed signals to the ECU 47. The ECU 47 is also provided with other signals from the various sensors in the engine as describe above. These parameters are used as the basis of combustion control procedure in controlling the ignition timing and the amount of fuel injection.

Since the idle position of the throttle valve 23 is set to an intermediate position between the conventional idle position and the full open position, sufficient air flow amount and air flow speed for the rapid acceleration are already established in the idle state of the engine. Therefore, the combustion response in the engine can quickly follow the accelerator movement from the idle to the maximum speed.

Moreover, the ECU 47 controls the ignition timing depending on the amount of movement in the cam member 42 until the cam member 42 reaches the pick-up position CP2. As a consequence, the combustion in the engine is promoted to further improve the acceleration characteristics for attaining the high rotation rate from the idle within a short period of time. Further, the ECU 47 controls the fuel injection per unit time such that smaller the accelerator movement, the smaller the rate of fuel injection. Therefore, because of the reduced fuel injection in the idle, the combustion in the engine is suppressed to maintain the lower rotation rate.

One of the features of the present invention resides in the fact that a compensation means for compensating in the amount of fuel to be injected to the engine is provided in the fuel injection control system. The compensation means calibrate or compensate variations in the crankcase pressure detected by the pressure sensor in consideration of conditions in the intake air to determine the amount of fuel to be injected.

As note above, one of the factors that deteriorates the accuracy in the measurement of the crankcase pressure resides in the fact that the intake air may include water vapor and/or vaporized fuel such as gasoline. As a result, the measured crankcase pressure by the pressure sensor includes pressure components based on the water vapor and the vaporized fuel other than the intake air pressure to be measured.

In the present invention, the ECU 47 is provided with a signal from the pressure sensor 55 which is indicative of the intake air pressure. The compensation means compensates the sensed pressure data based on the various conditions in the intake air. Such conditions vary depending on how much the intake air pressure is affected by, for example, water vapor and the vaporized fuel. These condition can be expressed by the parameters including temperature of the intake air, humidity of the intake air and fuel characteristics.

The measured data from the pressure sensor is corrected based on the degree of fuel vaporization and water vapor in the intake air. Therefore, in the fuel injection control system of the present invention, the amount of fuel from the fuel injector 24 can be determined solely by the intake air pressure. As a consequence, the accurate control of the fuel injection can be achieved in the present invention which will result in the improvement of fuel economy.

Figure 3:
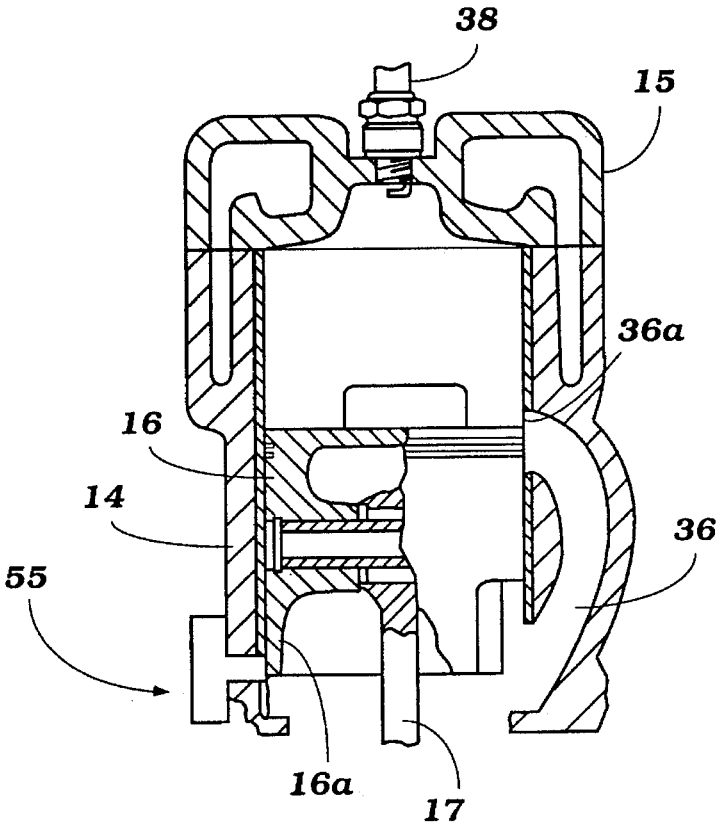
FIG. 3 is a sectional view showing an enlarged view of a cylinder including a piston and a pressure sensor of the present invention.

In the preferred embodiment of the present invention, the pressure sensor 55 is installed at the lower part of the fifth cylinder as shown in FIG. 3. In this embodiment, only one pressure sensor 55 is used in the fifth cylinder on behalf of all the other cylinders. This is one of the unique features of the present invention, which will be described in more detail later.

Figure 4:
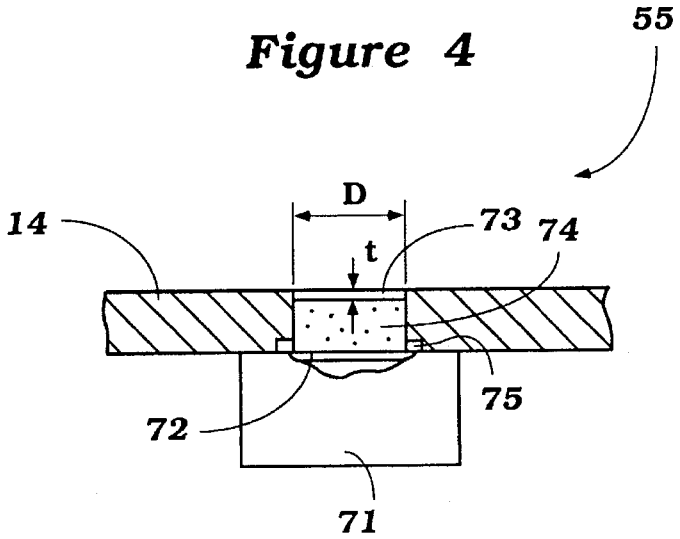
FIG. 4 is a sectional view showing a structure of an example of pressure sensor applicable to the fuel injection control system of the present invention.

As illustrated in FIG. 4, the pressure sensor 55 has a dual-diaphragm structure wherein an inner diaphragm 72 and an outer diaphragm 73 are provided on a sensor body 71. The inner diaphragm 72 is attached to the sensor body 71 through an O-ring 75 and directly transmits pressure to the sensor body 71. The outer diaphragm is exposed to the inside of the crankcase. Silicon oil 74 is filled between a space formed by the inner diaphragm 72 and the outer diaphragm 73. The frequency characteristics of this type of pressure sensor is mainly determined by the resonance frequency of the outer diaphragm 74. In the pressure sensor 55 of the preferred embodiment, the diameter D and the thickness t of the outer diaphragm are selected to achieve a resonance frequency of higher than 1 KHz.

As shown in FIG. 3, the piston 16 has a skirt portion 16*a* which acts to protect the pressure sensor 55. More precisely, in the preferred embodiment, with respect to a scavenge port 36*a*, from 5 degrees to 30 degrees after the scavenge opening and from 5 degrees to 30 degrees before the scavenge closing, the skirt portion 16 shields the conditions pressure sensor 55 so that the pressure sensor 55 will not be not exposed to the inside of crankcase during these period.

Namely, during the period when the scavenge port 36*a* forms a direct path between the combustion chamber and the scavenge path 36, the pressure sensor is protected by the skirt portion 16*a* so as not to receive the effect of a backfire in the engine. Further, the pressure sensor 55 is provided at the side crankcase opposite to the scavenge path 36 which will also be effective to eliminate the unwanted effect of the backfire. Therefore, the structure of the present invention can improve the reliability and life of the pressure sensor.

The ECU 47 has maps (information table) to select values for controlling the various engine parameters under the fuel injection control system of the present invention. A tentative intake air map is provided for selecting a tentative amount of intake air. A compensation map is provided for determining compensation factors on the basis of the intake air temperature, the intake air humidity and the fuel characteristics (such as volatility of gasoline). A fuel injection map is provided for determining the amount of fuel to be injected based on the compensated intake air and the engine rotational rate.

Figure 5:
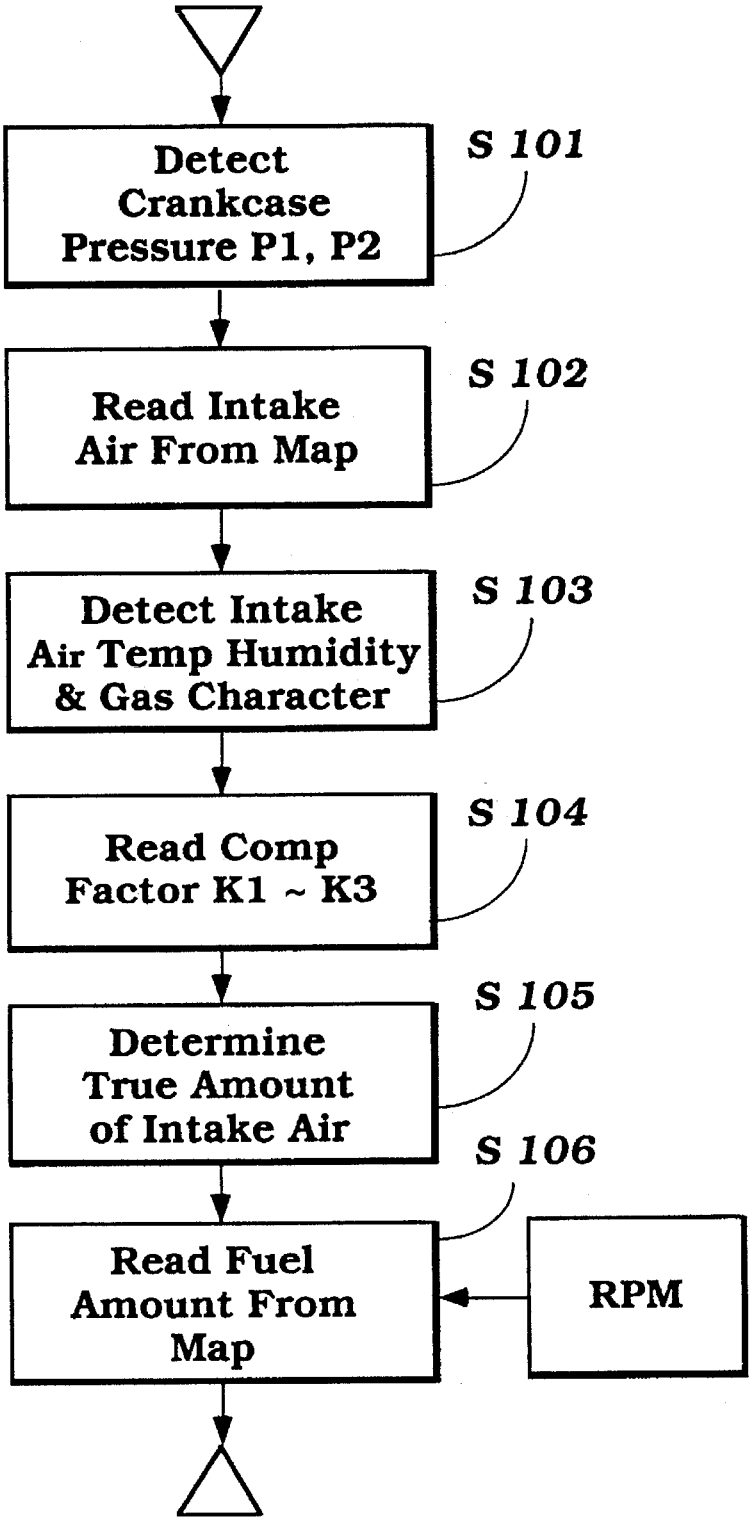
FIG. 5 is a flow chart showing the control routine for determining the fuel injection amount based on crankcase pressure and compensation factors thereof in accordance with the present invention.

FIG. 5 is a flow chart showing the control routine for determining the fuel injection amount based on the crankcase pressure (intake air amount) and the compensation factors thereof in accordance with the present invention. Once the program starts, it moves to the step S101 wherein the crankcase pressure P1 and P2 are measured by the pressure sensor 55. The timing for extracting the crankcase pressure P1 and P2 from the sensor 55 is shown in FIGS. 6 and 7.

Figure 6:
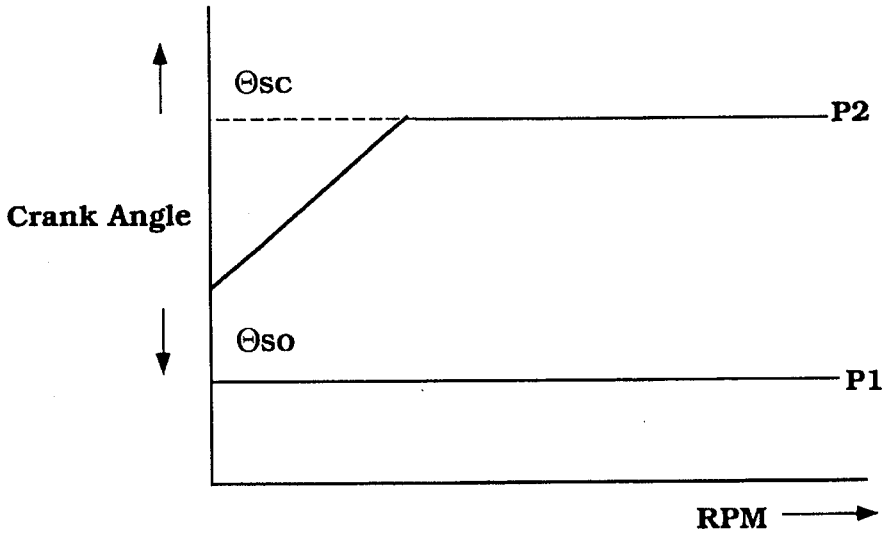
FIG. 6 is a graphical view showing timing for sensing the crankcase pressure under the control routine of FIG. 5.

FIG. 6 shows timing for sensing crankcase pressure which is expressed by the crank angle and the engine rotation rate. FIG. 7 shows timing for sensing crankcase pressure which is expressed by the crankcase pressure and crank angle. In FIGS. 6 and 7, $\theta_{so}$ designates a crank angle at the opening of the scavenge port 36*a* and $\theta_{sc}$ designates a crank angle at the closing of the scavenge port 36*a*. The crankcase pressure P1 is detected at the crank angle $\theta_{so}$ and the crankcase pressure P2 is detected at the crank angle $\theta_{so}$.

Figure 7:
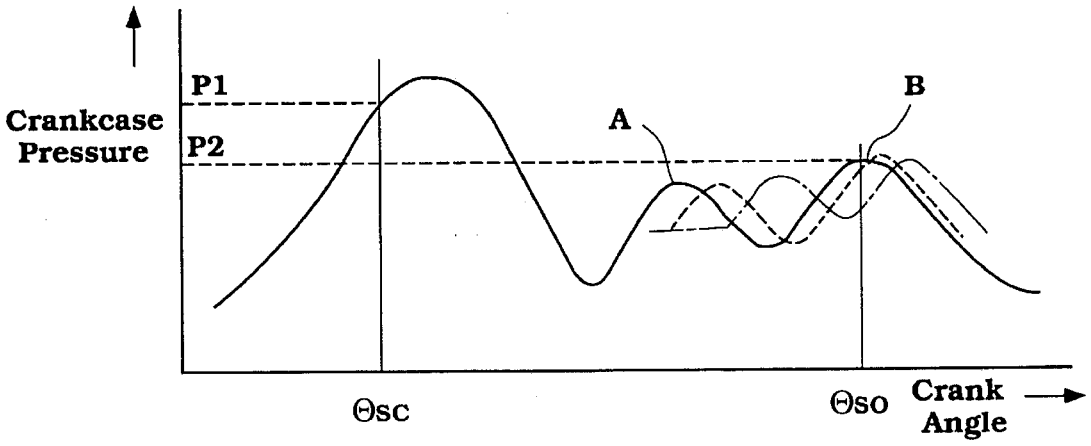
FIG. 7 is a graphical view showing timing for sensing the crankcase pressure under the control routine of FIG. 5.

In FIG. 7, a peak A indicates the effect on the crankcase pressure by the exhaust gas pressure in the sixth cylinder. Similarly, a peak B indicates the effect on the crankcase pressure by the exhaust gas pressure in the first cylinder. As noted above, in the preferred embodiment, the pressure sensor 55 is installed in the fifth cylinder. These peaks A and B of the crankcase pressure move to the right hand side with increase of the engine rotation rate (crank angle), i.e., from the solid line to the broken line and then to the single dotted line. Thus, the timing for detecting the crankcase pressure P2 also moves to the right hand side. When the engine rotation rate attains greater than the predetermined speed, the detection timing for crankcase pressure P2 becomes $\theta_{sc}$.

In the step S102, based on the crankcase pressure P1 and P2 detected in the step S101, the tentative intake air G' is determined by the reading in the tentative intake air map. In the next step S103, the intake air condition is determined based on the following parameters, the intake air temperature, the intake air humidity and the fuel characteristics (such as volatility of gasoline). Then the program moves to the step S104 wherein the compensation factors K1, K2 and K3 are determined from the reading in the compensation map according to the data obtained in the step S103.

In the step S105, the ECU 47 calculates a true amount of intake air G utilizing the tentative intake air G' and the compensation factors K1, K2 and K3. First, an overall compensation factor K is calculated by multiplying the compensation factors K1, K2 and K3, as expressed bellow.

$$K=K1\times K2\times K3$$

Then, the ECU 47 calculates the true amount of intake air G by multiplying the overall compensation factor K with the tentative intake air G', as expressed bellow.

$$G=G'\times K$$

In the next step S106, the amount of fuel to be injected is readout from the map based on the true intake air G and the engine rotation rate.

Figure 8:
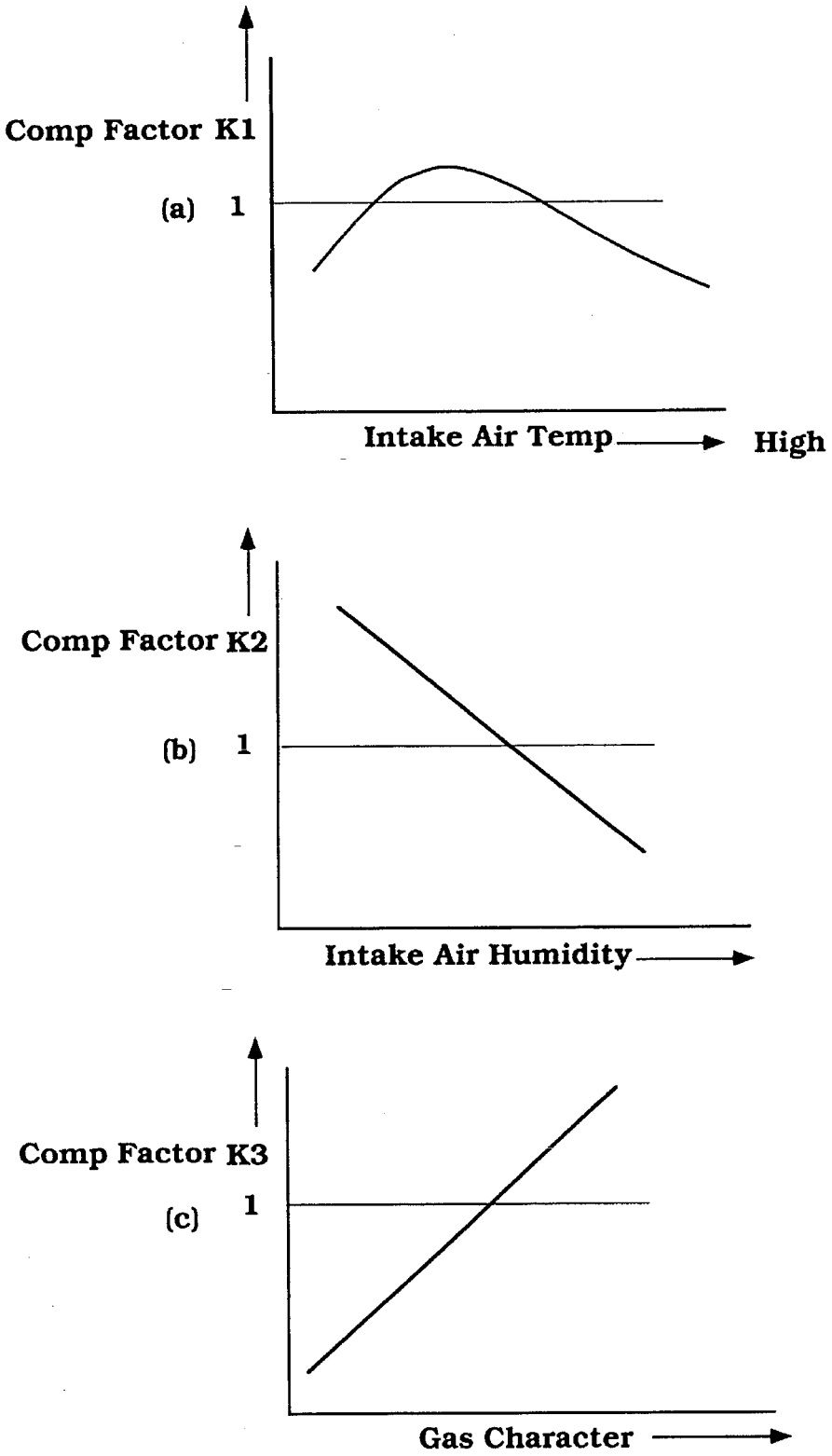
FIG. 8 is a graphical view for explaining the compensation factors for the crankcase pressure under the control routine of FIG. 5.

FIGS. 8*a*, 8*b* and 8*c* are graphical views for explaining the compensation factors K1, k2 and K3 for the crankcase pressure under the control routine of FIG. 5. The compensation factor K1 in FIG. 8*a* is to correct for errors in the tentative intake air caused by the intake air temperature. Air density varies depending on the air temperature and affects the air pressure in the crankcase. Thus, the compensation factor K1 varies accordingly with the temperature as a curved line in FIG. 8*a*. The compensation factor K2 in FIG. 8*b* is to correct for errors in the tentative intake air caused by the intake air humidity. Water vapor pressure varies depending on the intake air humidity and affects the air pressure in the crankcase. Thus, the compensation factor K2 varies accordingly with the humidity as a straight line in FIG. 8*b*. The compensation factor K3 in FIG. 8*c* is to correct for errors in the tentative intake air caused by the fuel characteristics. The fuel characteristics such as gasoline volatility affects the intake air temperature because of latent heat associated with the vaporization. The change in the air temperature causes an error in the measurement of the crankcase pressure. Thus, the compensation factor K3 varies accordingly with the fuel characteristics as expressed by the straight line in FIG. 8*c*.

As has been foregoing, according to the present invention, the amount of fuel injected from the fuel injector 24 is accurately controlled by analyzing the intake air conditions and compensating for the conditions so that the fuel injection is affected solely by the true value of the crankcase pressure.

Another aspect of the present invention is to provide a fuel injection control system which is capable of accurately determining the amount of fuel to be injected without being affected by the exhaust gas pressure by the cylinder where the sensor is installed and by other cylinders.

As noted above in the first aspect of the present invention, the crankcase pressure measurement is performed to determine the intake air pressure and ultimately to determine the amount of fuel to be injected to the engine. Such a crankcase pressure measurement is made at two different times. One measurement is performed at the time of starting scavenge (scavenge port opening timing) and the other measurement is performed at the time of ending the scavenge (scavenge port closing timing). The intake air pressure will be calculated based on these two measurement results.

In these measurements, however, an impulse-like pressure caused by an exhaust gas pressure may sometimes come into the crankcase chamber through a cylinder and a scavenge path. Such an impulse-like pressure of the exhaust gas may derive not only from the cylinder for which the scavenge timing in question in being measured but also from the other cylinders which are in the exhaust timing. Especially, this pressure caused by the exhaust in the other cylinder affects the crankcase pressure measurement at the end timing of the scavenge. As a result, it is difficult to obtain accurate air pressure data, and thus, it is difficult to accurately control the fuel injection.

In the present invention, the fuel injection control system incorporates a timing control means for adjusting the timing for detecting the crankcase pressure depending on the engine rotation speed. Therefore, the detection of the crankcase pressure can be made at the time during which the crankcase pressure is not affected by the exhaust gas pressure. As a result, more accurate measurement of the intake air and thus more accurate control of the fuel injection is possible in the present invention.

For accomplishing this invention, the ECU 47 includes a crankcase pressure detection timing map for determining the detection timing of the crankcase pressure based on the engine rotation rate in addition to the other maps mentioned above. Further, the compensation factor map in this invention includes additional information for determining the compensation factor K by a parameter different from that of the first aspect of the invention.

As noted above, the crankcase pressure is measured at around the scavenge port opening timing and at around the scavenge port closing timing. In the present invention, the detection timing for the scavenge port opening is held constant while the detection timing for the scavenge port closing is controlled to be delayed in the crank angle with the increase of the engine rotation speed. Since the timing which affects the crankcase pressure as a result of the exhaust gas pressure moves close to the scavenge port closing timing with the increase of the engine rotation speed, it is possible to accurately measure the crankcase pressure by delaying the detection timing to avoid the effects of exhaust gas pressure.

Figure 9:
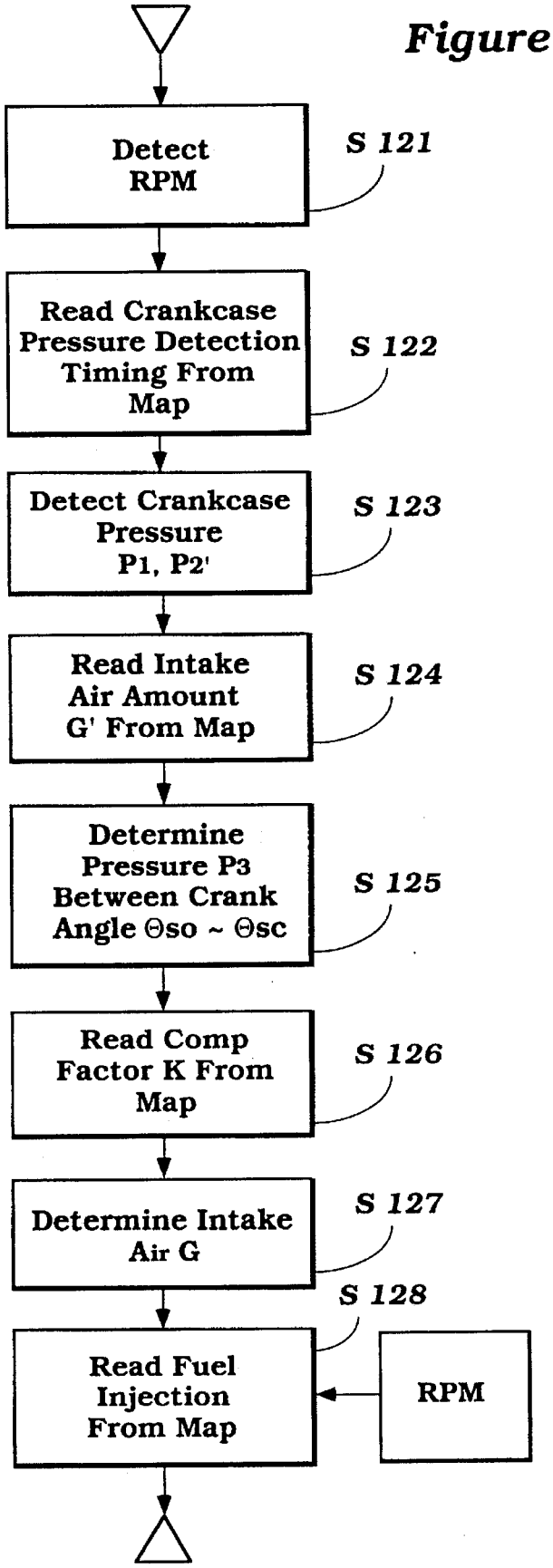
FIG. 9 is a flow chart showing the control routine for the fuel injection for adjusting the timing for sensing the crankcase pressure based on the engine rotation rate.
Figure 10:
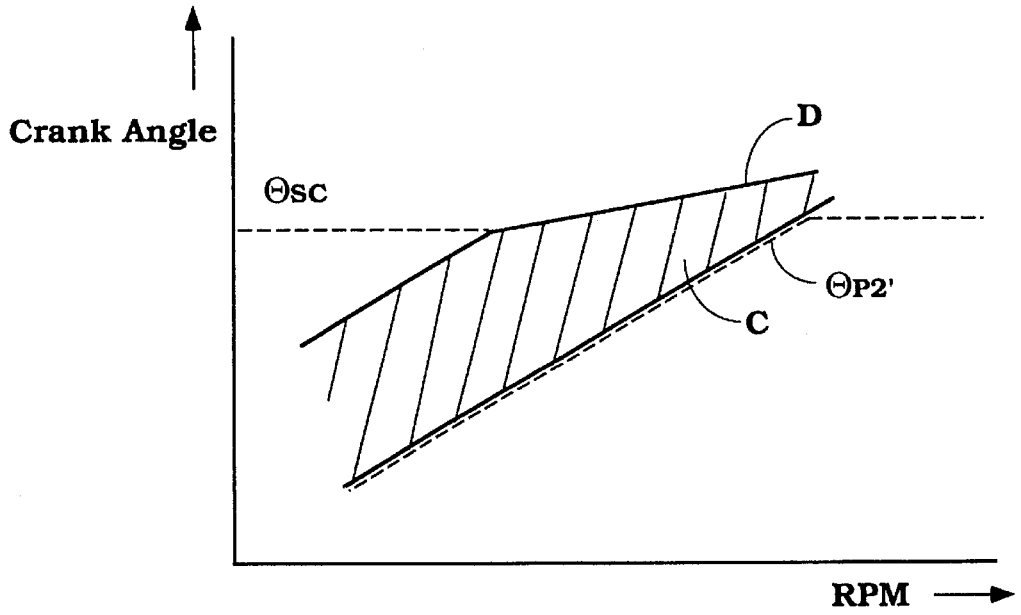
FIG. 10 is a graphical view showing the timing for sensing crankcase pressure under the control routine of FIG. 9.
Figure 11:
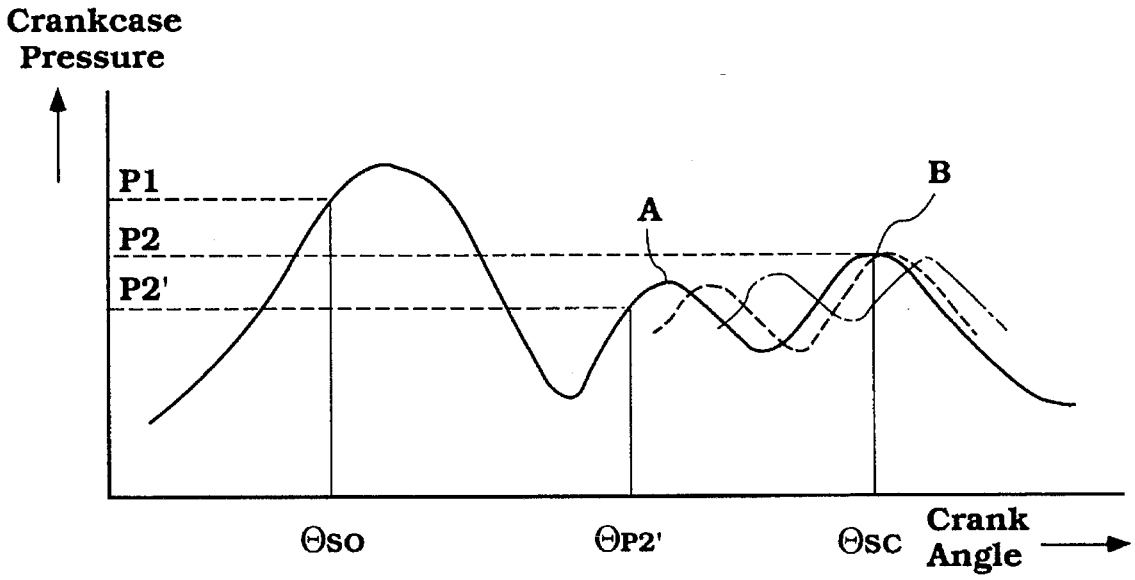
FIG. 11 is a graphical view showing the timing for sensing crankcase pressure under the control routine of FIG. 9.

FIG. 9 is a flow chart showing the control routine by the ECU 47 for adjusting the timing for detecting the crankcase pressure and compensating the measured result by compensation factors determined by the controlled detection timing in accordance with the present invention to obtain accurate data of the fuel injection. FIGS. 10 shows the timing for sensing crankcase pressure in terms of the crank angle and the engine rotation rate. FIG. 11 shows the timing for sensing crankcase pressure in terms of the crankcase pressure and the crank angle.

In FIGS. 10 and 11, $\theta_{so}$ designates a crank angle at the opening of the scavenge port 36*a* (FIG. 3) and $\theta_{sc}$ designates a crank angle at the closing of the scavenge port 36*a*. P1 is the crankcase pressure detected at the timing of the crank angle $\theta_{so}$, and P2 is the crankcase pressure detected at the timing of the crank angle $\theta_{so}$. P2' is the crankcase pressure detected at the timing of the crank angle $\theta_{p2}$, which is prior to the points where the effects by the exhaust gas pressure by the cylinder exist. For example, in FIG. 11, a peak A indicates the effect on the crankcase pressure by the exhaust gas pressure in the sixth cylinder. Similarly, a peak B indicates the effect on the crankcase pressure by the exhaust gas pressure in the first cylinder.

In FIG. 9, once the program starts, it moves to the step S121 wherein the ECU determines the engine rotation rate based on the signal from the sensor 56 which senses the crank angle. In the step S122, by using the engine rotation rate obtained in the step 121 as a parameter, the detection timing for the crankcase pressure P1 and P2' is determined by the crankcase pressure detection map. The engine rotation rate can be replaced with data of throttle valve position (throttle angle) or the throttle valve position can be an additional parameter.

As shown in FIG. 11, the detection timing for the crankcase pressure P2' in this case comes at the crank angle $\theta_{p2}$, which is prior to the peaks A and B. Therefore, it is possible to measure the crankcase pressure by avoiding the peaks A and B. Typically, the crank angle $\theta_{p2}$, varies depending on the engine rotation rate as shown in FIGS. 10 and 11. Such characteristics of the crank angle and the engine rotation rate for each specific engine can be obtainable in advance by an experiment.

In the example of FIGS. 10 and 11, The peaks A and B move to the right hand side as illustrated by the solid line, the broken line and the single dotted line. Accordingly, the crank angle $\theta_{p2}$, also shifts its position to the right hand side in FIG. 11. Namely, as shown in FIG. 10, the crank angle $\theta_{p2}$, for detecting the pressure P2' moves in the retard angle direction, which is further effective to eliminate the effect of the exhaust gas pressure.

In FIG. 10, a shaded area surrounded by the solid lines C and D indicates an area where the exhaust gas pressure of the cylinder having the pressure sensor and the other cylinder affects the crankcase pressure. In the solid line D, the gradient above the crank angle $\theta_{sc}$ becomes small since the scavenge port 36*a* is almost closed at this crank angle so that the effect of the exhaust gas pressure can be reduced.

In the step S123, the crankcase pressure P1 and P2' is measured at timing determined in the step S122 by the pressure sensor 55. In the next step S124, based on the crankcase pressure P1 and P2' detected in the step S123, the tentative intake air G' is determined by the reading in the tentative intake air map.

Figure 12:
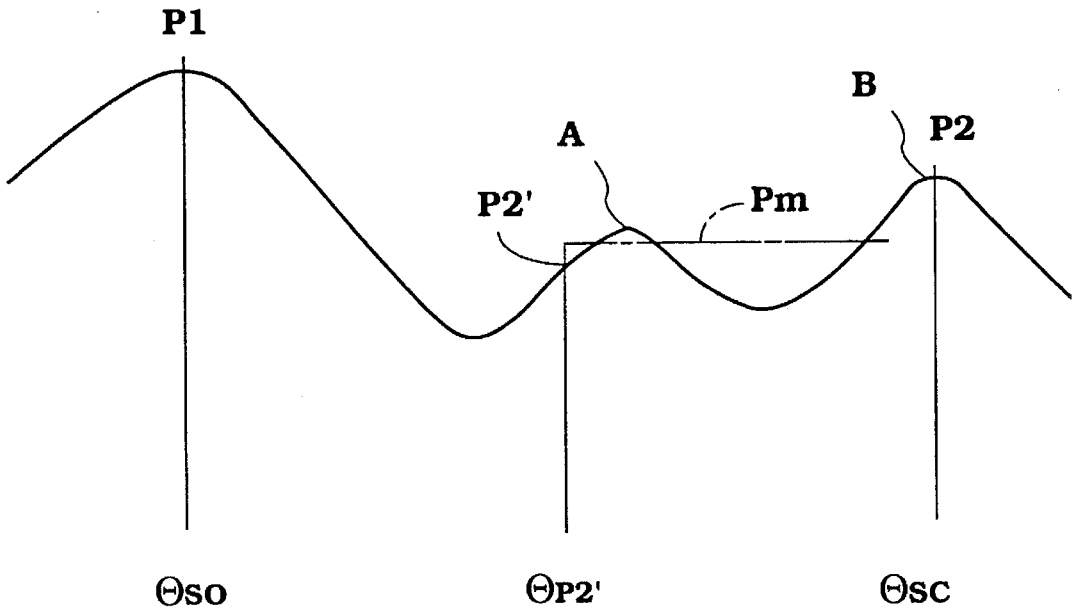
FIG. 12 is a graphical view for explaining the process of obtaining a mean value of crankcase pressure under the control flow of FIG. 9.

In the next steps S125–S127, the tentative intake air G' is compensated to obtain the true value G. First, in the step S125, the ECU calculates a crankcase pressure P3 between the crank angles $\theta_{p2}$, and $\theta_{sc}$. Various ways are possible for determining the crankcase pressure P3, i.e., as shown in FIG. 12, (1) to use an average value Pm of crankcase pressure between the crank angles $\theta_{p2}$, and $\theta_{sc}$, (2) to use the maximum value P2 of crankcase pressure between the crank angles $\theta_{p2}$, and $\theta_{sc}$, (3) to use Pm/P2', and (4) to use P2/P2'. In the preferred embodiment, the pressure P3 is obtained by the average value described in (1).

In the next step S126, based on the pressure P3 as a parameter, the compensation factor K is determined from the reading in the compensation factor map. Then, in the step S127, the ECU 47 calculates the true amount of intake air G by multiplying the overall compensation factor K with the tentative intake air G', as expressed bellow.

$$G=G'\times K$$

In the next step S128, the amount of fuel to be injected is readout from the map based on the true intake air G and the engine rotation rate.

As has been foregoing, according to the present invention, the fuel injection control system includes the timing control means for adjusting the timing for detecting the crankcase pressure depending on the engine rotation speed. Therefore, the detection of the crankcase pressure can be made at the times during which the crankcase pressure is not affected by the exhaust pressure. As a result, more accurate measurement of the intake air and thus more accurate control of the fuel injection is possible in the present invention.

A further aspect of the present invention is to provide a fuel injection control system which is capable of accurately determining the amount of fuel to be injected by measuring the crankcase pressure of one cylinder by one pressure sensor installed in the cylinder and compensating the measured crank pressure for the effects cause by the other cylinders in the engine.

The crankcase pressure measurement is performed to determine the intake air pressure and ultimately to determine the amount of fuel to be injected to the engine to improve fuel economy in the engine. In the crankcase pressure measurement, it is necessary to install a pressure sensor in each cylinder to measure the intake air with high accuracy. As a consequence, in an engine having a large number of cylinders, for example, six cylinders, six pressure sensors have to be installed.

However, such a large number of pressure sensors causes the structure of the system and the process for measuring the intake air too much complicated. In case where one or two pressure sensors are installed to represent other cylinders, accurate measurement is not possible since the crankcase pressure and intake air are different from cylinder to cylinder. As a result, it is not possible in the conventional crankcase pressure measurement to precisely control the fuel injection.

In the present invention, the fuel injection control system incorporates a means for calculating compensated crankcase pressure to determine the true crankcase pressure in consideration of the interference caused by exhaust gas pressure of the other cylinders. In this arrangement, since the pressure sensing is performed only in the predetermined cylinder, it is not necessary to install pressure sensors in all of the cylinders in the engine. The amount of compensation for the interference by the other cylinders may be varied depending on the engine rotation rate to further improve the accuracy of the fuel injection.

Therefore, the present invention can provide a fuel injection control system for an engine which has a simplified structure and calculation process for determining the fuel injection. Further, the present invention can provide a fuel injection control system for an engine which is capable of detecting a misfire in a certain cylinder and compensate for the effect of such misfire in measurement of the crankcase pressure to accurately control the amount of fuel injection to the engine.

For accomplishing this invention, the ECU 47 includes a compensation factor map for determining a compensation factor on the basis of interference characteristics caused by the exhaust gas pressure between the cylinders and the engine rotation rate. The tentative intake air map, the fuel injection map and the crankcase pressure detection timing map are also used in this invention.

Figure 13:
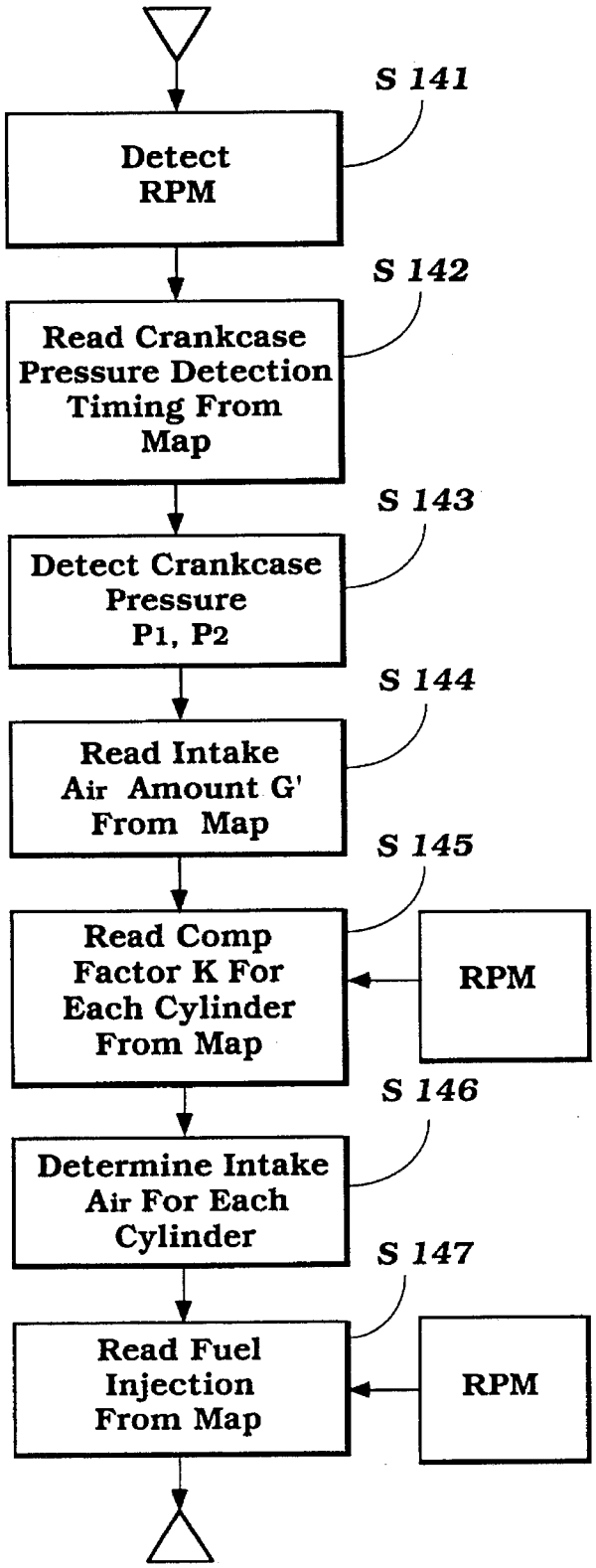
FIG. 13 is a flow chart showing the control routine for the fuel injection by sensing crankcase pressure in one cylinder and obtaining an overall intake air based on the crankcase pressure and a compensation factor.
Figure 14:
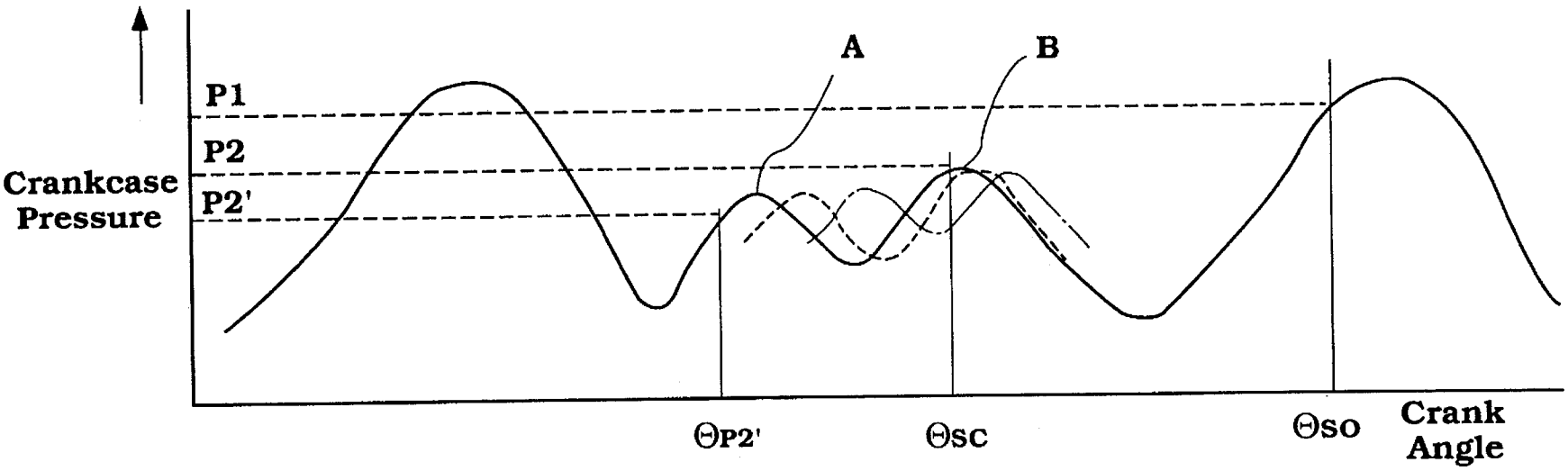
FIG. 14 is a graphical view showing the timing for sensing crankcase pressure under the control routine of FIG. 13.
Figure 15:
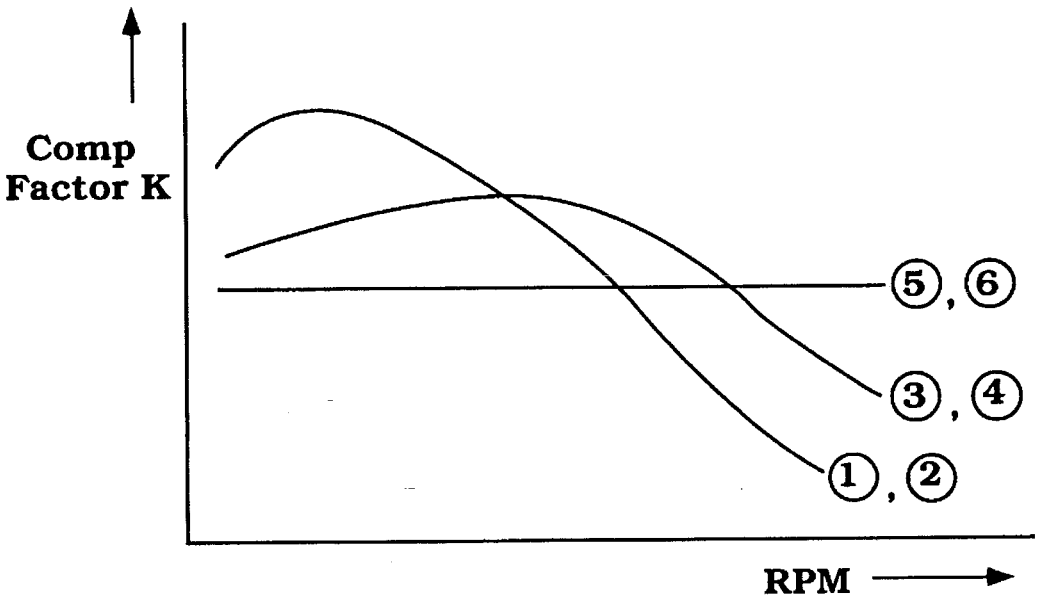
FIG. 15 is a graphical view showing the compensation factor for each cylinder in the engine under the control routine of FIG. 13.

FIG. 13 is a flow chart showing the control routine by the ECU 47 for measuring the crankcase pressure and compensating the measured result by the compensation factors determined by the interference between the cylinders in accordance with the present invention to obtain accurate data of the fuel injection. FIG. 14 shows the timing for sensing crankcase pressure in terms of the crankcase pressure and the crank angle. FIG. 15 shows the compensation factor K for each cylinder.

In FIG. 14, $\theta_{so}$ designates a crank angle at the opening of the scavenge port 36*a* (FIG. 3) and $\theta_{sc}$ designates a crank angle at the closing of the scavenge port 36*a*. P1 is the crankcase pressure detected at the timing of the crank angle $\theta_{so}$, and P2 is the crankcase pressure detected at the timing of the crank angle $\theta_{so}$. P2' is the crankcase pressure detected at the timing of the crank angle $\theta_{p2}$, which is prior to the points where the effects by the exhaust gas pressure by the cylinder exist. The peak A indicates the effect on the crankcase pressure by the exhaust pressure in the sixth cylinder. A peak B indicates the effect on the crankcase pressure by the exhaust pressure in the first cylinder.

In FIG. 13, once the program starts, it moves to the step S141 wherein the ECU determines the engine rotation rate based on the signal from the sensor 56 which senses the crank angle. In the step S142, by using the engine rotation rate obtained in the step 121 as a parameter, the detection timing for the crankcase pressure P1 and P2 is determined by the crankcase pressure detection timing map. The crankcase pressure P2 can be replaced with the pressure P2' at the crank angle θp2, in FIG. 11.

In the step S143, at the timing determined in the step S142, the crankcase pressures P1 and P2 for the fifth cylinder are detected by the pressure sensor 55. In the next step S144, the tentative intake air G' is obtained from the reading in the tentative intake air map. The tentative intake air G' can be expressed as:

$$G'=Q1-Q2$$

wherein Q1 is an amount of air in the fifth cylinder corresponding to the pressure P1 and Q2 is an amount of air in the cylinder corresponding to the pressure P2.

The program proceeds to the step S145, wherein the compensation factor K for each cylinder is determined by the compensation factor map on the basis of the engine rotation rate. The reason that the compensation factor K for each cylinder is necessary is that the engine in the preferred embodiment as shown in FIG. 1 is a collective exhaust type multi-cylinder engine. In this type of engine, there is a difference in the length between scavenge paths for corresponding cylinders. Thus, the interfering effect by the exhaust pressure varies from cylinder to cylinder. The amount of interfering effect for each cylinder can be obtained by an experiment once the engine structure is fixed. FIG. 15 shows the compensation factor for each cylinder of the engine experimentally determined.

In FIG. 15, the compensation factor for the fifth and sixth cylinders is constant with respect to the engine rotation rate, since in this embodiment, the fifth cylinder is used as a reference and the sixth cylinder is in a symmetrical position with the fifth cylinder. The compensation factor K for the first and second cylinders is larger when the engine rotation rate is lower and decreases with the increase of the engine rotation rate. The changes of the compensation factor K for the third and fourth cylinders is smaller than that of the first and second cylinders. This is because there is a greater difference in the interference characteristics between the fifth, sixth cylinders and first, second cylinders than between the fifth, sixth cylinders and third, fourth cylinders.

In the step S146, the ECU 47 calculates the true amount of intake air G for each cylinder by multiplying the compensation factor K with the tentative intake air G', as expressed bellow.

$$G=G'\times K$$

In the next step S147, the amount of fuel to be injected for each cylinder is readout from the map based on the true intake air G and the engine rotation rate.

As has been described, according to the present invention, the measurement of the crankcase pressure is made only for the fifth cylinder. The crankcase pressure for the other cylinders is calculated based on the crankcase pressure of the fifth cylinder, the interference characteristics and the engine rotation rate. Therefore, the precise control of the fuel injection will be achieved while simplifying the structure of the system.

Furthermore, in the two-cycle engine, there will arise a misfire wherein one or more cylinders fail to fire. In such a situation, the crankcase pressure is affected by the misfire and thus it is difficult to accurately measure the crankcase pressure by the pressure sensor. As a consequence, it is difficult to control the fuel injection solely based on the crankcase pressure measurement.

In the present invention, it is possible to detect the misfire in the other cylinders by monitoring the crankcase pressure of the predetermined one or two cylinders and compensate for the effect of the misfire to accurately control the fuel injection. During the period when both the scavenge port and the exhaust port in the subject cylinder are open (overlapping period), the exhaust gas pressure of the other cylinder enters the crankcase of the subject cylinder through the scavenge path. Therefore, the crankcase pressure at this time is indicative of the combustion situation in the other cylinder. When there is a misfire in the other cylinder, the crankcase pressure in the subject cylinder becomes small. As a result, by measuring the crankcase pressure, it is possible to detect the misfire in the other cylinder.

Generally, the overlapping period of the scavenge timing and the exhaust timing arises between 123 degrees to 237 degrees in the crank angle. Therefore, considering the propagation delay time of the exhaust gas pressure, in the V-6 engine, misfires in the second cylinder which is 60 degrees apart and the third cylinder which is 120 degrees apart are detectable if the pressure sensor is provided in the first cylinder.

In case of a V-4 engine, a misfire in the second cylinder which is 90 degrees apart is detectable by the pressure sensor in the first cylinder. In a three cylinder in-line engine, a misfire in the second cylinder is detectable by the pressure sensor in the first cylinder. For the V-4 engine, the misfire compensation described bellow will be achieved by installing the pressure sensors in the first and third cylinder. In the case of the three cylinder in-line engine, the pressure sensors can be installed in any two cylinders.

For accomplishing this invention, the ECU 47 additionally includes a misfire map for determining a compensation factor when there is a misfire in the other cylinder on the basis of engine rotation rate and the crankcase pressure. The tentative intake air map, the fuel injection map and the crankcase pressure detection timing map are also used in this invention.

Figure 16:
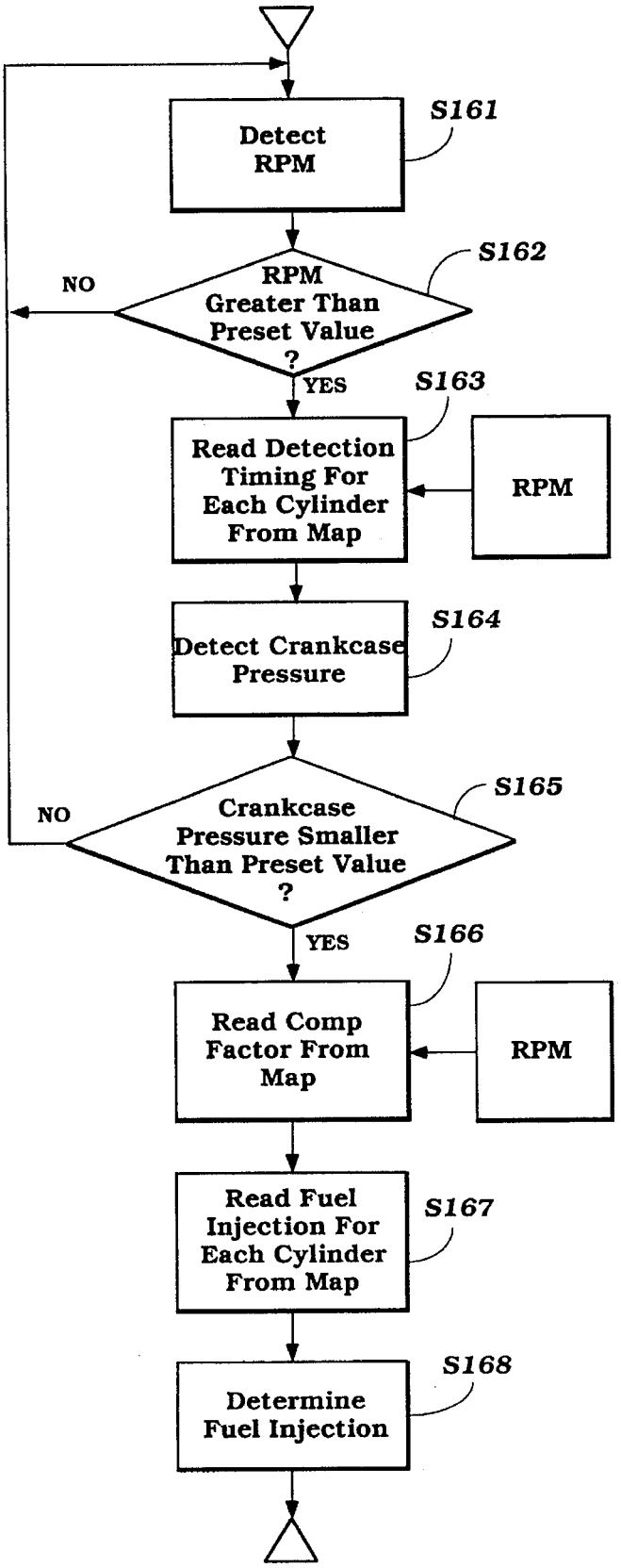
FIG. 16 is a flow chart showing the control routine for the fuel injection by detecting a cylinder which has failed to fire and compensating the affect caused by such a misfire in the cylinder.
Figure 17:
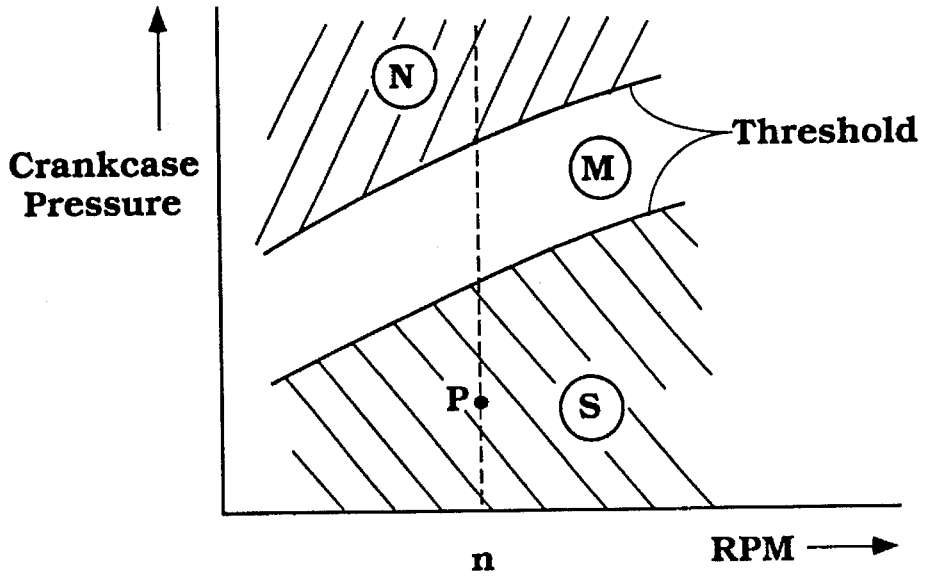
FIG. 17 is a graphical view showing relationship between the engine rotation rate and the crankcase pressure in terms of the misfire in a cylinder under the control routine of FIG. 16.
Figure 18:
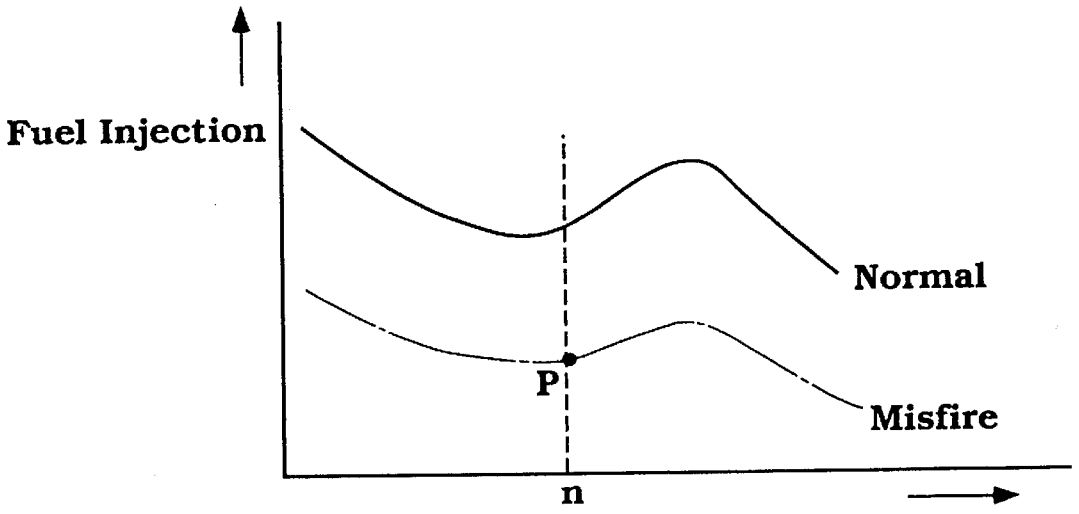
FIG. 18 is a graphical view for explaining the amount of fuel injection when there is a misfire in a cylinder under the control routine of FIG. 16.

FIG. 16 is a flow chart showing the control routine of the present invention to detect the misfire and compensate for the effect caused by the misfire to accurately determine the amount of fuel to be injected. FIG. 17 is a graphical view showing relationship between the engine rotation rate and the crankcase pressure in terms of the misfire for explaining the threshold value under the control routine of FIG. 16. FIG. 18 is a graphical view for explaining the amount of fuel injection when there is a misfire under the control routine of FIG. 16. In the preferred embodiment, the pressure sensors are installed in the cylinders between which the crank angle is 180 degrees, for example, the first cylinder and the fourth cylinder.

In the step S161, the engine rotation rate is detected based on the signal from the crank angle sensor 56. In the step S162, the ECU 47 compares the engine rotation rate with the preset value which is a rotation rate selected from the low speed drive range. If the rotation rate is lower than the preset value, the program moves to the step S163.

In the step S163, based on the engine rotation rate, the detection timing for the crankcase pressure in the first and fourth cylinders is selected from the reading the detection timing map. Under this routine, the timing is determined in the map such that the effect of exhaust gas pressure in the other cylinders clearly appears to the crankcase pressure of the first and fourth cylinder. In the step 164, the crankcase pressure is measured in the first and fourth cylinders at the timing determined in the step 163.

In the step S165, the ECU compares the crankcase pressure thus obtained in the step S164 with the preset value. The preset value in this case is a threshold value shown by the solid line in FIG. 17. In FIG. 17, the shaded area N represents the crankcase pressure without misfires and shaded area S represents the crankcase pressure with misfires. The area M is a marginal area between the areas N and S. If it is determined in the step S165 that the crankcase pressure P is in the area N, the program returns to the step S161 and repeats the steps S161–S165. If it is determined that the crankcase pressure is in the area S in FIG. 17, the program proceeds to the step S166.

In case where the crankcase pressure is in the area S in FIG. 17, that means that there is a misfire in the other cylinder. Therefore, In the step S166, based on the crankcase pressure and the engine rotation rate as parameters, the compensation factor K for each cylinder is selected from the misfire map. Then, in the step S167, the fuel ignition amount and the fuel ignition timing for each cylinder are determined from the reading in the fuel injection map.

In the next step S168, the fuel injection amount obtained in the step S167 is multiplied by the compensation factor obtained in the step S166. In this situation, in the preferred embodiment, the fuel injection start timing for the cylinder with misfire is the same as the other cylinder. However, the fuel injection end timing for the misfired cylinder comes earlier than the other cylinders. Therefore, the amount of fuel provided to the misfired cylinder is reduced as shown in FIG. 18, which improves the fuel economy and also promotes the misfired cylinder returning to the normal operation.

In case where the amount fuel injection is determined by the measurement of the crankcase pressure P1 and P2, it is practically difficult to inject all the fuel thus determined in the present cycle of the engine. Therefore, in the conventional system, the determined fuel injection is performed in the next cycle of the engine. However, to improve accuracy in the fuel injection, it is preferable to inject the fuel in the present cycle. Thus, in the preferred embodiment of the present invention, it is arranged that the major portion, for example 80%, of the fuel determined in the previous cycle is injected in the present cycle and at the same time, the total amount of fuel is adjusted to be the same as the one determined in the present cycle.

Figure 19:
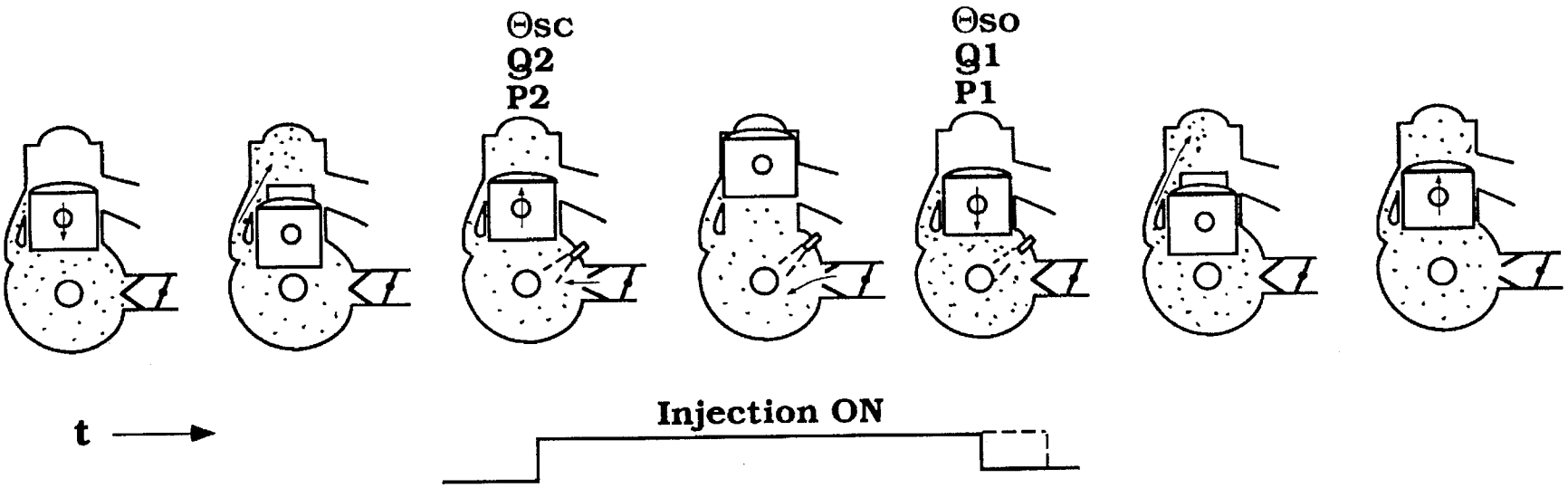
FIG. 19 is a graphical view showing a fuel injection process in accordance with the present invention.

This procedure is shown in FIG. 19. The system detects the crankcase pressure P2 at the scavenge closing timing $\theta_{sc}$, and based on the pressure P2, obtains the intake air Q2 in the present cycle. The system also detects the crankcase pressure P1 at the scavenge opening timing $\theta_{so}$, and based on the pressure P1, obtains the intake air Q1 in the present cycle.

Thus, the amount of intake air in the present cycle is determined by the difference between Q1 and Q2.

Then, in the fuel injection operation, for example, 80% of fuel determined in the previous cycle is injected in the present cycle during the period between $\theta_{sc}$ and $\theta_{so}$ (the solid line in FIG. 19), and the rest of the fuel for the present cycle is provided after the timing $\theta_{so}$ (the broken line in FIG. 19). In this invention, since the fine tuning of the fuel injection is accomplished in the present cycle, it is possible to further improve the fuel injection accuracy. For performing this procedure, it is preferable to arrange the fuel injector 24 such that the fuel injector 24 can directly spray the fuel in the crankcase.

As has been described, according to the present invention, it is possible to detect the misfire in the other cylinders by monitoring the crankcase pressure of the predetermined one or two cylinders and compensate the effect of the misfire to accurately control the fuel injection.

Although the foregoing description has been made with reference to the preferred embodiments of the invention, various changes and modifications may be made without departing from the spirit and scope of the invention, as defined by the appended claims.

We claim:

1. A fuel injection control system for a two-cycle internal combustion engine, comprising a pressure sensor installed in a cylinder of said engine for detecting crankcase pressure at the time of scavenge opening and scavenge closing to obtain a tentative intake air amount, a fuel injector for injecting fuel to said engine on the basis of said crankcase pressure detected by said pressure sensor, means for compensating the amount of fuel injected from said fuel injector in response to the condition of intake air in said crankcase to obtain a compensation factor to be multiplied by said tentative air amount to determine a true amount of fuel to be injected.

2. A fuel injection control system as defined in claim 1, wherein, said condition of said intake air includes temperature, humidity of said intake air and fuel volatility in said intake air.

3. A fuel injection control system as defined in claim 1, wherein said pressure sensor comprises;

an inner diaphragm and an outer diaphragm mounted on a sensor body;

silicon oil filled between said inner diaphragm and said outer diaphragm.

4. A fuel injection control system as defined in claim 3, wherein said pressure sensor is positioned to be protected by a skirt of a piston in said cylinder from a backfire in said cylinder and in other cylinders of said engine.

5. A fuel injection control system for an internal combustion engine, comprising a pressure sensor installed in a cylinder of said engine for detecting crankcase pressure, a fuel injector for injecting fuel to said engine on the basis of said crankcase pressure detected by said pressure sensor, means for controlling the timing of detecting said crankcase pressure by said pressure sensor depending on the rotation rate of said engine.

6. A fuel injection control system as defined in claim 5, wherein said crankcase pressure is measured by said pressure sensor at the timing of scavenge opening and at the timing of scavenge opening, said means for controlling said detection timing controls said timing such that said timing of measurement upon scavenge opening is held constant while said timing of measurement upon said scavenge closing is delayed in accordance with the the increase of said rotation rate of said engine.

7. A fuel injection control system for an internal combustion engine, comprising a pressure sensor installed in a cylinder of said engine for detecting crankcase pressure, a fuel injector for injecting fuel to said engine on the basis of said crankcase pressure detected by said pressure sensor, means for determining the amount of fuel to be injected to said engine by incorporating a compensation factor in said crankcase pressure obtained by said pressure sensor, said compensation factor including compensation for the effect caused by exhaust gas pressure in other cylinders.

8. A fuel injection control system as defined in claim 7, wherein said compensation factor varies depending on the rotation rate of said engine.

9. A fuel injection control system as defined in claim 7, wherein said system determines crankcase pressure in all the cylinders in said engine on the basis of said crankcase pressure sensed by said pressure sensor installed in only one cylinder by utilizing said compensation factor.

10. A fuel injection control system as defined in claim 8, wherein said system detects a misfire in other cylinders and compensates for effect caused by said misfire to determine a true amount of fuel to be injected by said fuel injector.

11. A fuel injection control system as defined in claim 7, wherein a substantial amount of said determined amount of fuel is injected determined from conditions, in the previous cycle of said engine and the remaining amount of fuel is determined by conditions in said present cycle.

* * * * *